US008113996B1

(12) United States Patent
Allen

(10) Patent No.: US 8,113,996 B1
(45) Date of Patent: Feb. 14, 2012

(54) DUAL ACTION RECUMBENT EXERCISE CYCLE

(76) Inventor: Tad Allen, Dunwoody, GA (US)

( * ) Notice: Subject to any disclaimer, the term of this patent is extended or adjusted under 35 U.S.C. 154(b) by 1 day.

(21) Appl. No.: 12/658,404

(22) Filed: Feb. 12, 2010

(51) Int. Cl.
*A63B 22/06* (2006.01)

(52) U.S. Cl. ..... 482/57; 482/62

(58) Field of Classification Search ..... 482/57, 482/58, 59, 62, 63, 111, 121, 122, 123, 126, 482/908
See application file for complete search history.

(56) References Cited

U.S. PATENT DOCUMENTS

| | | | | |
|---|---|---|---|---|
| 2,790,485 | A * | 4/1957 | Franklin | 297/116 |
| 4,188,030 | A * | 2/1980 | Hooper | 482/59 |
| 4,451,033 | A | 5/1984 | Nestegard | |
| 4,625,963 | A * | 12/1986 | Lancellotti | 482/130 |
| 4,741,527 | A | 5/1988 | Nestegard | |
| 4,850,587 | A | 7/1989 | Lin | |
| 4,852,872 | A | 8/1989 | Lo | |
| 4,880,225 | A * | 11/1989 | Lucas et al. | 482/59 |
| 4,889,335 | A | 12/1989 | Chen | |
| RE34,478 | E | 12/1993 | Dalebout et al. | |
| 5,356,356 | A | 10/1994 | Hildebrandt et al. | |
| 5,443,434 | A | 8/1995 | Buchanan et al. | |
| 5,496,092 | A * | 3/1996 | Williams et al. | 297/250.1 |
| 5,916,065 | A * | 6/1999 | McBride et al. | 482/57 |
| 6,042,518 | A | 3/2000 | Hildebrandt et al. | |
| 6,277,056 | B1 * | 8/2001 | McBride et al. | 482/57 |
| 6,361,479 | B1 | 3/2002 | Hildebrandt et al. | |
| 6,902,515 | B2 | 6/2005 | Howell et al. | |
| 7,267,639 | B2 | 9/2007 | Kuo | |
| 2004/0009847 | A1 * | 1/2004 | Stevens | 482/51 |

OTHER PUBLICATIONS

Schwinn Fitness Airdyne found online at http://www.schwinnfitness.com/schwinn_fitness_us/products/airdyne/prdcdovr~3550012/Schwinn+Airdyne+Exercise+Bike.jsp.

* cited by examiner

*Primary Examiner* — Loan Thanh
*Assistant Examiner* — Tam Nguyen
(74) *Attorney, Agent, or Firm* — Crose Law LLC; Bradley D. Crose

(57) ABSTRACT

A dual action recumbent exercise cycle which provides upper body, lower body and cardiovascular conditioning with emphasis directed toward the needs of obese individuals as well as individuals with equilibrium issues such as Parkinson's Disease, Multiple Sclerosis and Stroke. The apparatus includes a multi-configurable seat which is horizontally displaced from the foot pedal and handlebar assemblies. A vaned wheel rotatably mounted on the frame and arranged to absorb energy by movement of the broad surfaces of the vanes against the surrounding body of air. A derailleur mechanism is provided for additional options of resistance intensity. Rotation of the wheel is effected through a pair of foot pedals and connected chain and sprocket/hub mechanism and/or through a pair of handlebar assemblies. The handlebar assemblies each include a pivotal spring housing mechanism which enables the handlebars to be both retractable and variable in their positioning to the user. Each handlebar assembly is pivotally connected to the frame and is also connected to a respective eccentric through a crank ring rotatably mounted on that eccentric and a drive bar connected to both the crank ring and the handlebar stem. The two eccentrics are arranged 180 degrees out of phase and are connected to the foot pedals so as to rotate in response to both the pivotal movement of the handlebar stems and the circular movement of the foot pedals. As the eccentrics are drivably connected to the vaned wheel, that vaned wheel is caused to rotate in response to rotation of the eccentrics.

18 Claims, 12 Drawing Sheets

Side View →

← Frontal (Used) View

DUAL ACTION RECUMBENT EXERCISE CYCLE

BACKGROUND OF THE INVENTION

1. Field of Invention

Figure 1:
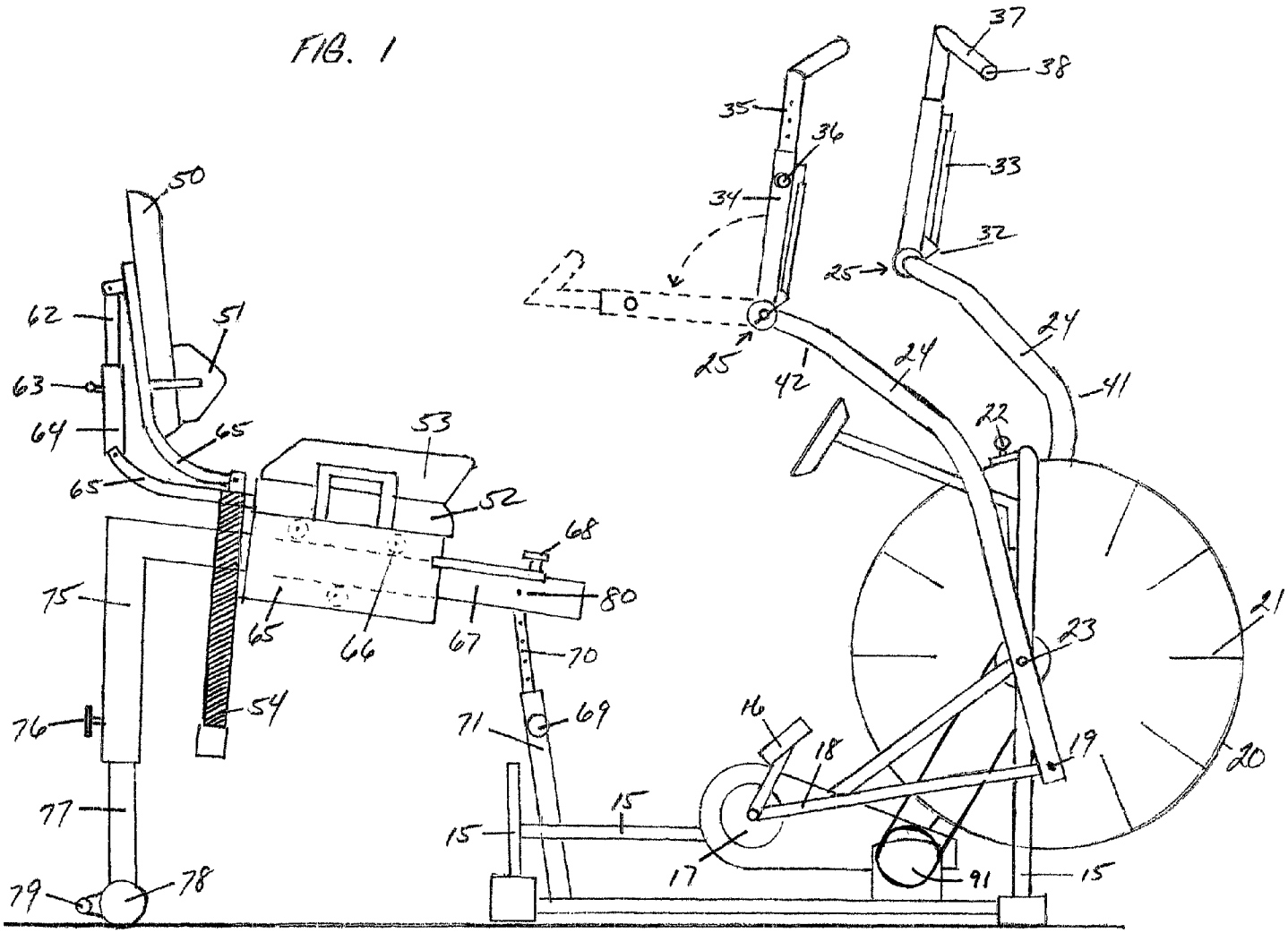

The present invention generally relates to cycle exercisers and recumbent exercisers for physical therapy and/or general exercise as disclosed in U.S. Pat. No. 4,188,030, and more particularly, to the recumbent exercise machines described in U.S. Pat. No. 7,267,639 and U.S. Pat. No. 6,361,479, which provides for the exercising and conditioning of major muscle groups in addition to cardiovascular conditioning. In doing so, the present invention includes lower body exercising coordinated with the upper body exercising.

2. Description of the Problem

In the United States of America today, approximately two thirds of the population is considered obese. In addition to this statistic, there are approximately 75 million "Baby Boomers", people born between 1946 and 1964 in this country today. Both obese individuals and aging or elderly individuals have special needs when it comes to exercising or physical therapy. Often, the individuals have limited mobility, health and or age related illnesses, decreased ranges of appendage movement, low endurance and the need for therapy with respect to more than one particular movement or muscle group. Many of the problems which face these two groups, which in many cases overlap include bad knees, hips, Diabetes, Arthritis, Multiple Sclerosis, Parkinson's Disease, and Stroke. All of these issues must be taken into consideration when designing and providing exercise and physical therapy equipment for their use. Another extremely important element of design and function must be comfort, especially for obese people. Since duration is one of the essential components of any rehabilitation or exercise program, the participant must be able to perform the exercises in a comfortable and secure environment. Otherwise the duration or time spent exercising will be limited. No exercise or rehabilitation machine on the market today effectively addresses the specific comfort needs of an individual weighing in excess of 250-300 pounds. In addition, people with equilibrium issues due to Stroke, Multiple Sclerosis, and Parkinson's disease must be secured on the equipment to prevent loss of balance and falling off of the machine. Furthermore, people who exercise for its many health benefits, and not specifically for rehabilitation purposes, typically desire equipment which is challenging, safe, effective, comfortable, and provides a benefit to a multiple number of muscle groups so that a total body workout is achieved in a relatively short period of time. When the equipment is for home use, other important considerations include durability and cost.

3. Description of the Prior Art

Exercise physiologists have concluded after many years of research that the most effective type of aerobic or cardiovascular exercise involves the use of both the upper and lower body extremities at the same time. There are several types and varieties of physical therapy and exercise equipment available on the market today for both clinical and home use which function accordingly. Examples include the Cycle Exerciser described in U.S. Pat. No. 4,188,030, the Recumbent Total Body Exerciser described in U.S. Pat. No. 6,361,479 and the Compound Bicycle Exercising Device described in U.S. Pat. No. 7,267,639.

Each of these types of machines, however, has certain limitations concerning the ease of use, range of motion, safety, comfort, and the muscle groups worked. Let's first address the multiple limitations of the Cycle Exerciser type of machine. The first limitation of the cycle exerciser is that the seat is a typically narrow saddle seat positioned above a pair of rotatable pedals having a fixed range of motion. The rotation of the pedals is resisted by a brake or other resistance mechanism. The user is required to lean forward to hold onto a set of handles, which in this case are moveable. In order to use the Cycle Exerciser, the user must be capable of climbing up onto the narrow saddle seat and must possess sufficient strength, balance, and coordination to maintain themselves on the narrow seat while pedaling over a fixed range of motion and manipulating the handles. Often the elderly, overweight, obese, or physical therapy patient cannot use the cycle exerciser because of the above requirements and further because they require constant supervision by the physical therapist to prevent possible injury to the patient upon collapse or loss of balance. In many cases even the most physically fit individual after a short period of time rocking back and forth on the narrow saddle seat due to the circular movement of the legs causes a high degree of discomfort to the posterior of the user thereby reducing the duration of time for exercise. Even professional and amateur cyclist compensate for this discomfort by wearing specially designed shorts with additional padding in the groin area.

As can be seen from the above discussion, there is the need for an apparatus which allows the user to easily get on and off of the apparatus with or without assistance. Furthermore, the apparatus should have a high degree of stability and safety for the user so that the user can operate the machine without constant attention or supervision. Additionally, the apparatus should be adjustable to accommodate users of significantly different sizes and physical conditions while still providing a comfortable environment for exercise or therapy The Recumbent Total Body Exerciser and the Compound Bicycle Exercising Device address many of the limitations described above with regard to the Cycle Exerciser in that it allows an overweight or physically challenged individual to more easily get on and off of the machine. However all recumbent machines on the market today are designed to provide a reasonably comfortable environment for an individual that is only somewhat overweigh or in good physical condition. The approximate width of the bucket type seat is usually around 24 inches and the back support is not adjustable. A user weighing in excess of 250-300 pounds cannot sit comfortably for any length of time on the seat and once again the duration of time for exercise or rehabilitation becomes limited. Another limitation of the Recumbent Total Exerciser, the Compound Bicycle Exercising Device and the Cycle Exerciser is the movement or range of motion of the arms or handlebars of the machines. Since the handlebars of these types of machines, operate from a pivot point where the handlebar is attached to the frame, the mechanically linked machines have only a rectilinear/arching arm motion in conjunction with various types of leg motion. Many times in the rehabilitation of shoulder joint injuries, rectilinear/arching motion alone is not sufficient for rehabilitation purposes. Often both linear and circular range of motion is necessary for the complete rehabilitation of the injured shoulder joint. Since the shoulder join operates and functions on all three planes, all ranges of motion, rectilinear/arching, linear, and circular should be provided by the exercising or physical therapy machine.

The application of resistance during the use of the exercise machine is also very important. Most of the exercise and physical therapy machines on the market today, including recumbent bicycles, ellipticals, and stair steppers utilize magnetic resistance. Magnetic resistance devices vary the resistance of the exercise machine through the interaction of a magnetic field from a magnet or array of magnets generating eddy currents in a material. The strength of the interaction is a function of the amount of magnetic flux interacting with the material, the greater the amount of magnetic flux interaction, the stronger the magnetic force. This relationship can be used to vary the resistance on a spinning wheel of the kind used in exercise machines. These present magnetic resistance devices do not include predictable fixed linear positioning systems which allow proportional step adjustments in the resistance. Limitations of magnetic resistance are two fold. One, upon initially establishing the resistance level the user has two choices. The user can either set the machine for a constant level of resistance or he or she can select a variable program. If when using the constant level of resistance, the user becomes fatigued, he must remove his hands from the handlebars to readjust the level on the console. If the rider has equilibrium issues the risk of losing one's balance is enhanced. If the variable program is selected, the change in level of resistance is automatic whether or not the user's fatigue level is commensurate to the resistance level.

The resistance mechanism used in the Cycle Exerciser is advantageous in that a vaned wheel mounted on a frame and arranged to absorb energy by movement of the broad surfaces of the vanes against the surrounding body of air. This enables the resistance to be exponential, in that the harder the user pushes and pulls the handlebars and pedals, the more the resistance increases.

Vice versa, when the user becomes fatigued, the amount of energy expended pushing and pulling on the handlebars and pedals decreases as does the resistance, thereby automatically adjusting the resistance level to the fatigue level of the user. Not only is this excellent conditioning of the muscles from an endurance standpoint, it is inherently much more beneficial and safer for a physical therapy patient in that the injured body component is not forced into a situation of handling a load greater than it is capable without risk of injury. The limitation of this type of resistance however is that if the user wants to increase the level of resistance for strengthening purposes, by mechanically or electronically changing the gear ratio of the apparatus, and thus the load, the option is unavailable.

SUMMARY OF THE INVENTION

In accordance with the present invention, there is provided a dual action recumbent exercise cycle with a multi-configurable seat which is horizontally displaced from the pedal and handlebar assemblies. The seat includes a cushioned seat bottom with cushioned adjustable locking leg flaps which lock into 5 different positions ranging from 90 degrees perpendicular to the seat bottom to a 0 degree flattened seat position. With the seat bottom leg flaps positioned at a 90 degree angle to the seat bottom, the seat will provides a comfortable, secure, seating environment for anyone as small as 90 lbs. with an 11 inch wide posterior. With the seat leg flaps flattened level to the seat cushion, the seat will accommodate a user weighing up to 500 lbs. with a 36 inch wide posterior or larger. All sizes of posteriors in between are accommodated and secure in that the seat leg flaps "cup" to fit the user's posterior, regardless of width.

The present invention provides an adjustable cushioned seat back with settings ranging from a 90 degree upright position to a 50 degree reclining position. The seat back also has 5 positioned adjustable locking torso flaps which supply support for the user's lower back midsection. A seat belt also provides lumbar support and additional security especially for users with equilibrium issues such as Multiple Sclerosis, Parkinson's Disease and Stroke victims. When the present invention is used for physical therapy, only moderate supervision at most is required, thereby freeing up the physical therapist to attend to other patients or duties.

The multi-configurable seat is mounted on a perforated spine utilizing polyurethane rollers for ease of movement. The rollers allow the seat to be moved back and forth to adjust for different body dimensions. A plunger pin is used to lock the seat into the perforated spine at the desired location. A vertical adjustment bar is also provided on the forward most point of the spine on the present invention to change elevation or pitch of the seat for the user. A similar feature is provided at the rear of the spine. These features are very beneficial in the rehabilitation of knee and hip injuries enabling less pressure and bend in the beginning of the rehabilitation process and intensifying pressure and bend as the knee and hip condition improves. The entire seat and spine assembly can be detached from the pedal and handlebar portion of the present invention at the vertical adjustment bar location to enable a wheel chair bound patient access to the invention for either upper and/or lower body exercise.

The user of the present invention is also provided with two telescopic, retractable, variable position handlebar assemblies. The handlebar assemblies are each comprised of a handlebar stem pivotally attached to the frame, a pivotal spring housing assembly which includes a stationary inside spring housing, a pivotal outside spring housing, a torsion spring, a flanged connecting rod, an extension arm housing, a perforated handlebar extension, a swivel handle, a retraction guard arm, and a compression damper. The pivotal spring housing assembly provides the user with arm and shoulder movement in multiple motions including linear, circular, elliptical, arching and rectilinear arching in conjunction with the cyclical leg motion. These components of the present invention provide a wide range of adjustments options to provide a comfortable exercising environment for anyone ranging in height from 4 foot 11 inches to a user as tall as 7 foot.

The relationship and geometry of the multi-configurable seat, the pedals, and variable position handlebar assemblies, is such that the movement of the users arms and legs will be maintained in a correct biomechanical relationship or form.

Accordingly, it is an object of the present invention to provide an apparatus which overcomes the limitations of the known prior art. In doing so, a further object of this invention is to provide a recumbent apparatus which can be mounted and dismounted, and adjusted and configured to address the exercise or rehabilitation needs of at least 98 percent of the adult population ranging in size from 4 foot 11 inches tall, weighing as little as 90 pounds to 7 feet tall weighting up to 500 pounds.

The present invention also has an one of its objects to provide a circular, cyclical motion to the lower body workout, both forward and backward, thus more efficiently addressing either the Quadriceps or Hamstring muscle groups of the legs. A further object of the invention is to provide an apparatus which provides a variety of upper body motions for both exercise and rehabilitation. These motions include linear, circular, elliptical, arching and rectilinear arching in conjunction with the cyclical leg motion, Another object of the invention is enabling the user to configure the seat in such a way as to put different emphasis on different muscle groups. For example, by positioning the seat back in a more vertical position, i.e. 90 degrees and pushing on the handlebars, the emphasis of exercise is placed on the Pectoralis Majors, front Deltoids, and Triceps of the upper body. Conversely, by placing the upper seat back in a more reclining position, the user incorporates the use of the Latissimus Dorsi, the rear Deltoids, the Biceps and the Trapezius more efficiently.

In achieving the above objects, the present invention provides not only a recumbent total body exercise apparatus but one that can be configured to address specific areas or portions of the body the user desires to concentrate on during the exercise or rehabilitation session.

Additional benefits and advantages of the present invention will become apparent to those skilled in the art to which this invention relates from the subsequent description of the preferred embodiment and the appended claims, taken in conjunction with the accompanying drawings.

BRIEF DESCRIPTIONS OF THE DRAWINGS

FIG. 1 A perspective view of the right side of the dual action recumbent exercise cycle in accordance with the first embodiment of the invention.

Figure 2:
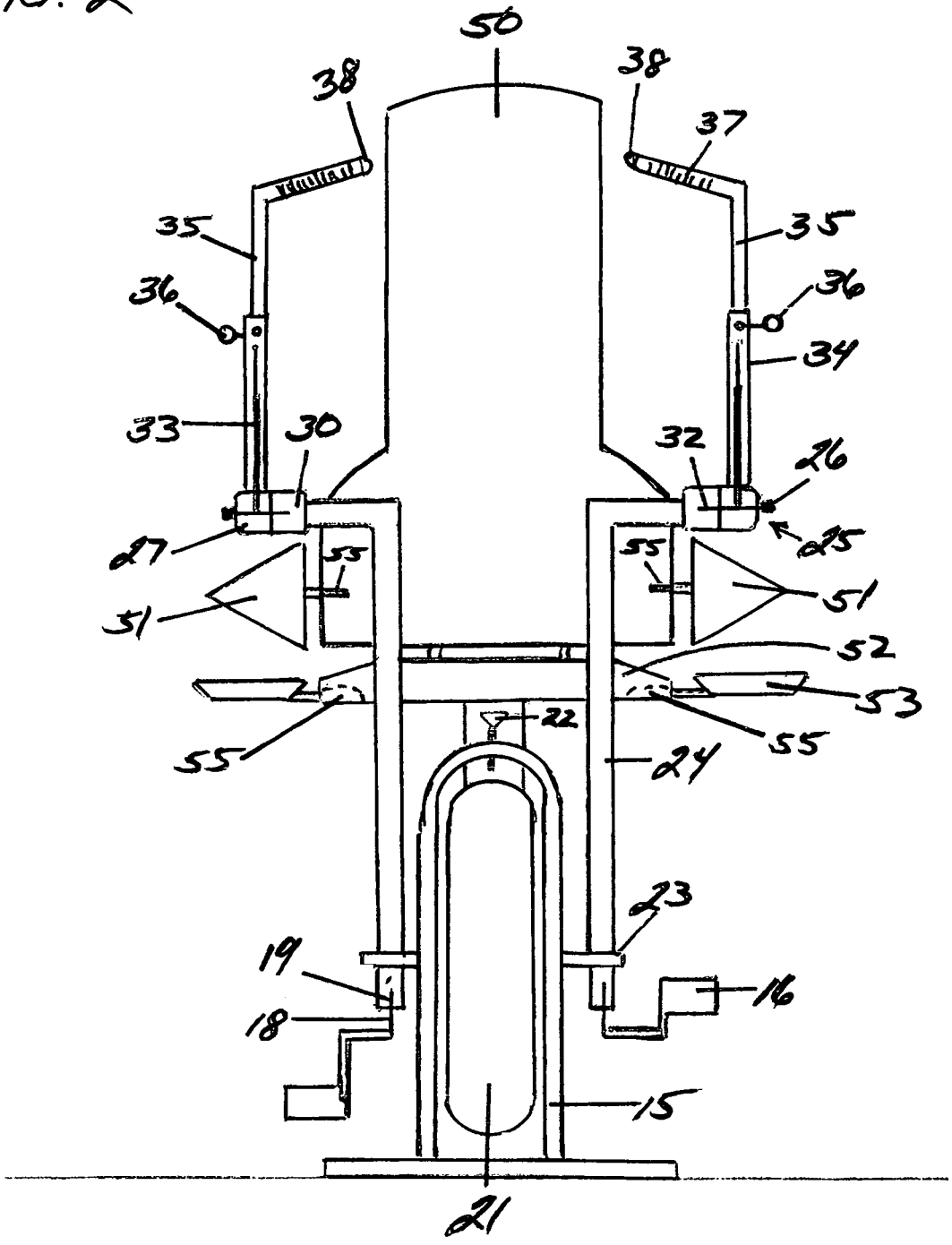

FIG. 2 A front perspective of the dual action recumbent cycle shown in FIG. 1.

Figure 3:
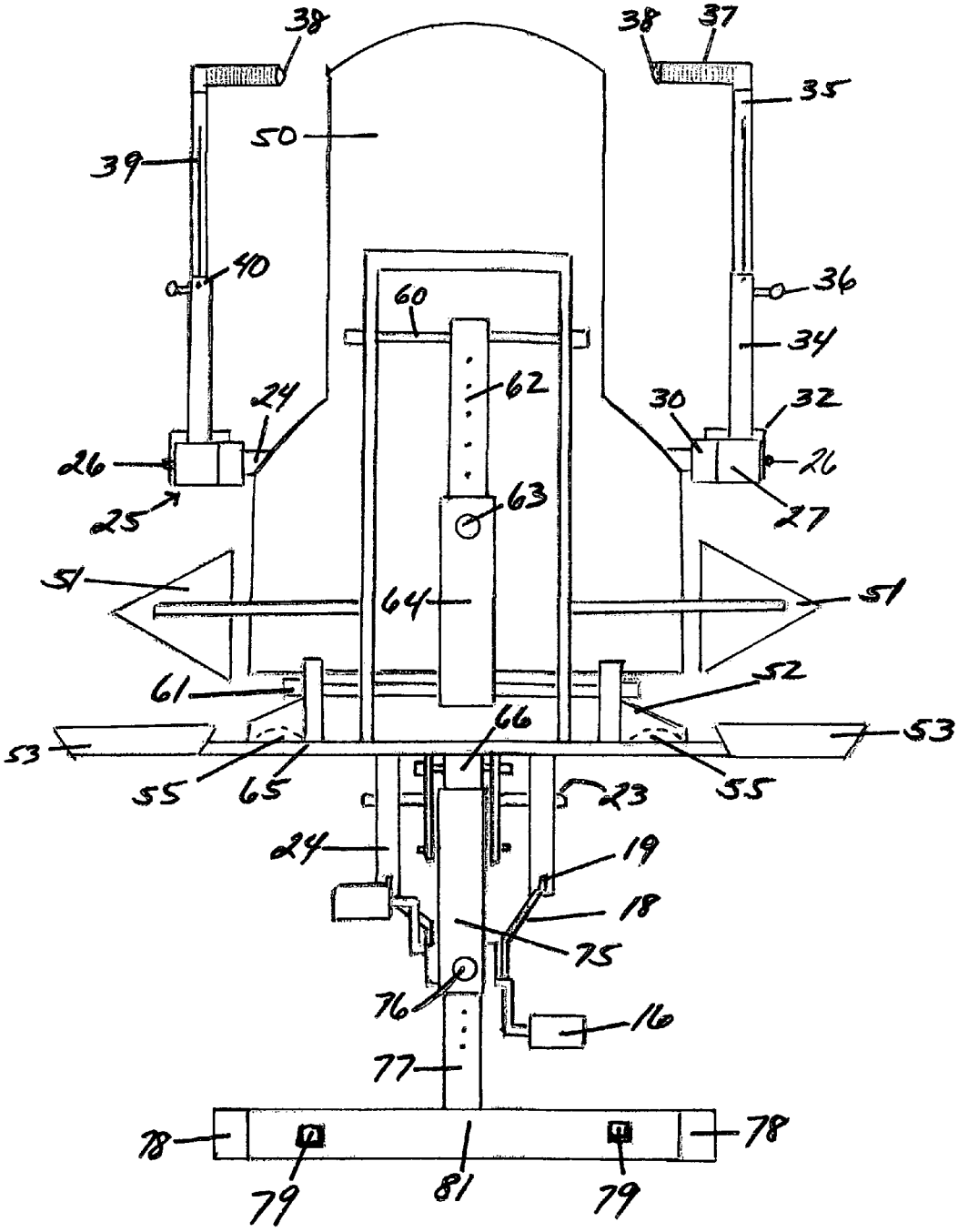

FIG. 3 A rear perspective of the dual action recumbent cycle shown in FIG. 1.

Figure 4:
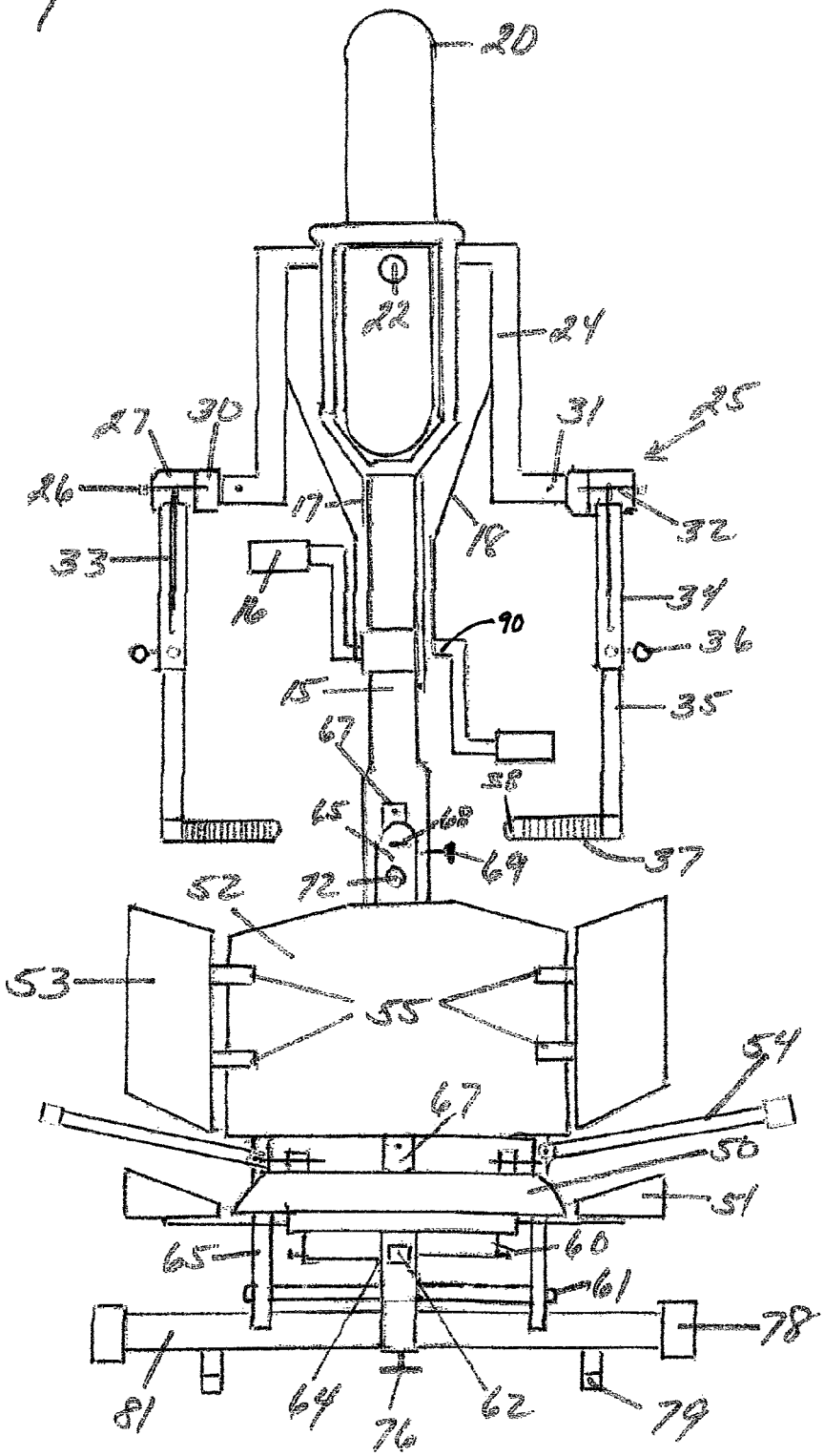

FIG. 4 A top perspective of the dual action recumbent cycle shown in FIG. 1.

Figure 5:
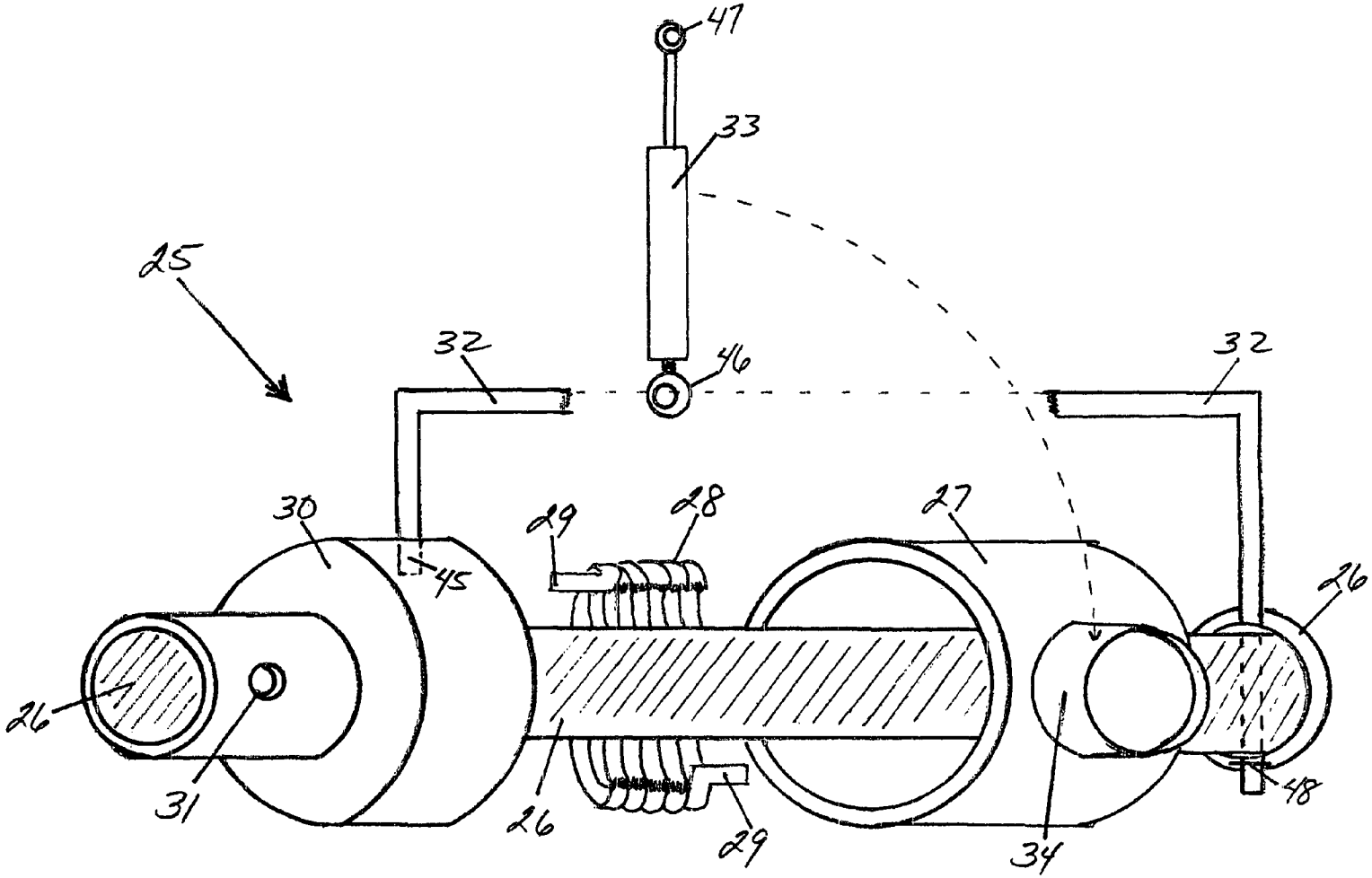

FIG. 5 An exploded view of the spring loaded Pivotal Spring Housing Assembly.

Figure 6:
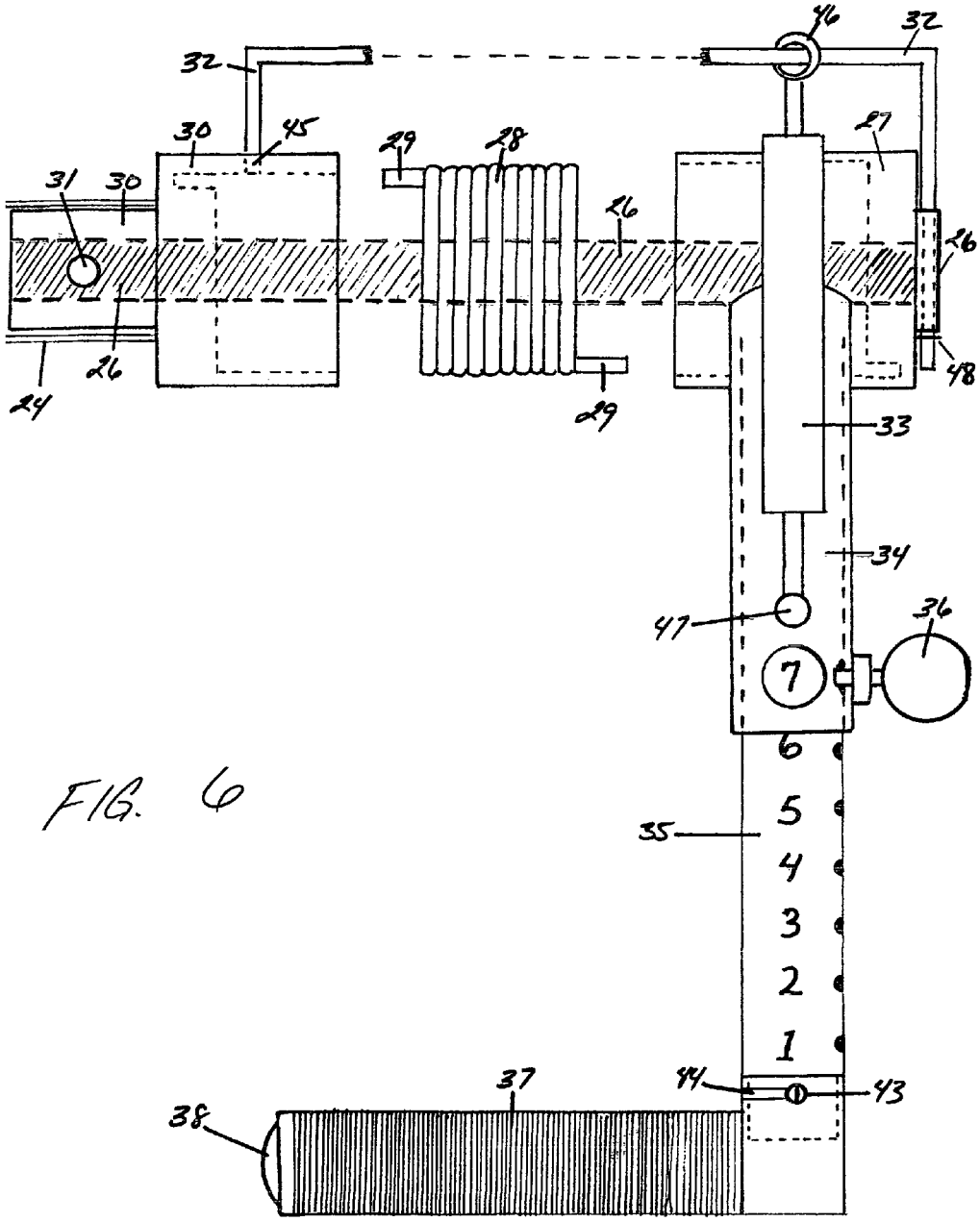

FIG. 6 An exploded view of the Pivotal Spring Housing Assembly, and the retractable, telescopic arm extension and swivel handle of the dual action recumbent cycle.

Figure 7:
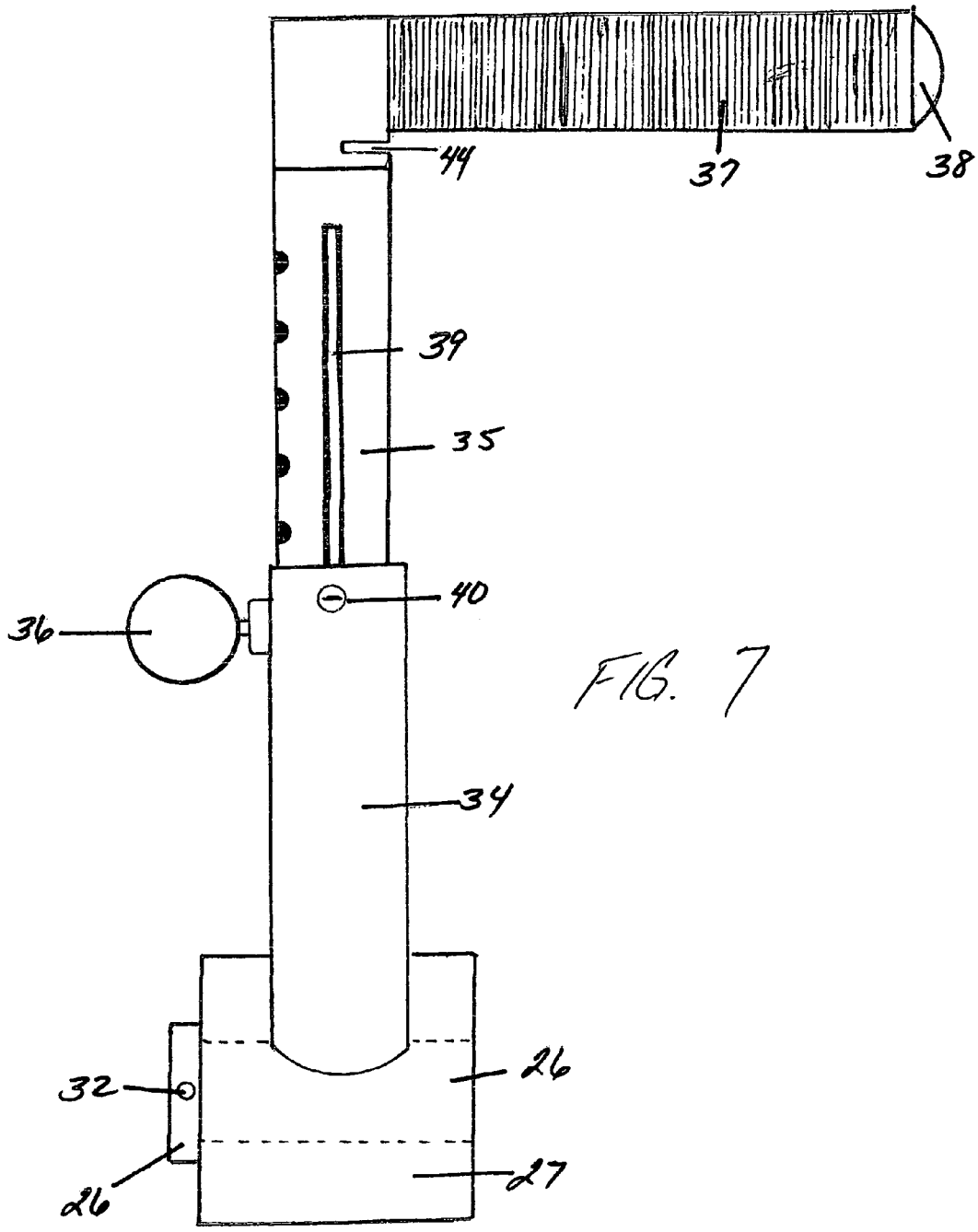

FIG. 7 A bottom perspective of the retractable, telescopic arm extension and swivel handle of the dual action recumbent cycle shown in FIG. 6.

Figure 8:
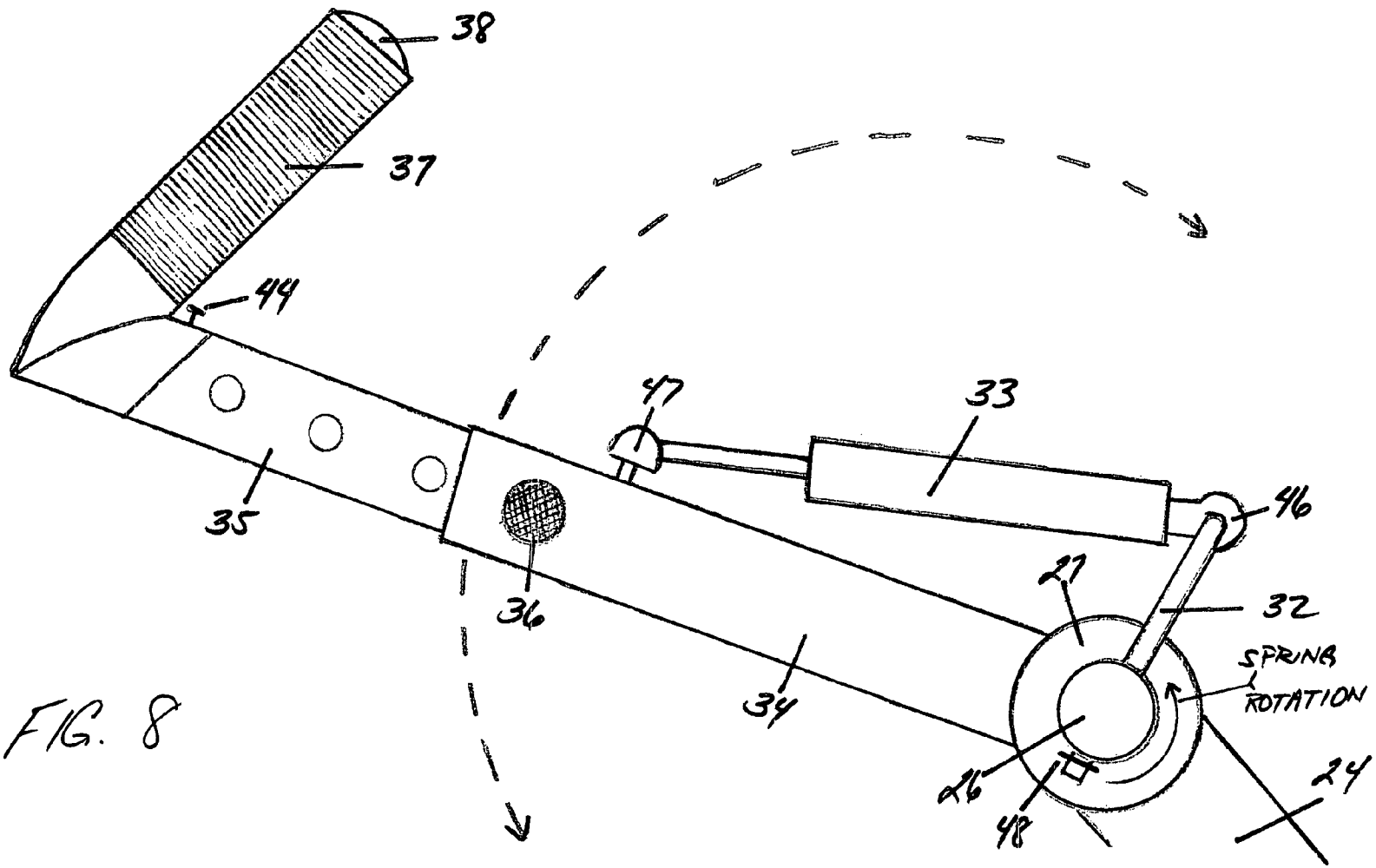

FIG. 8 A perspective of the right side of the spring loaded pivotal spring housing assembly with the retractable, telescopic arm extension and swivel handle of the dual action recumbent cycle shown in FIG. 6.

Figure 9B:
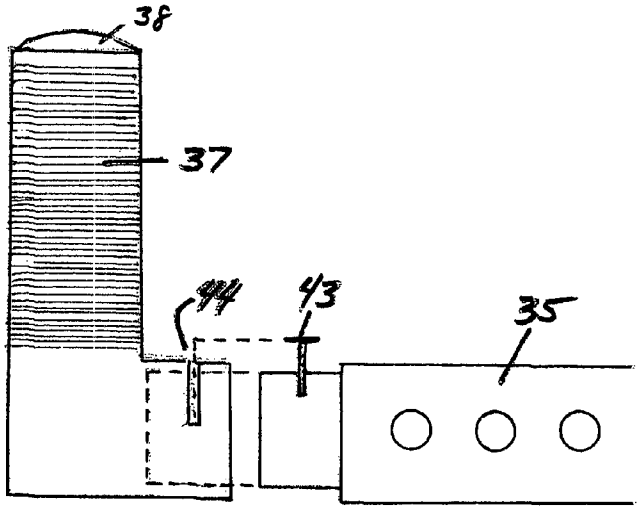
Figure 9A:
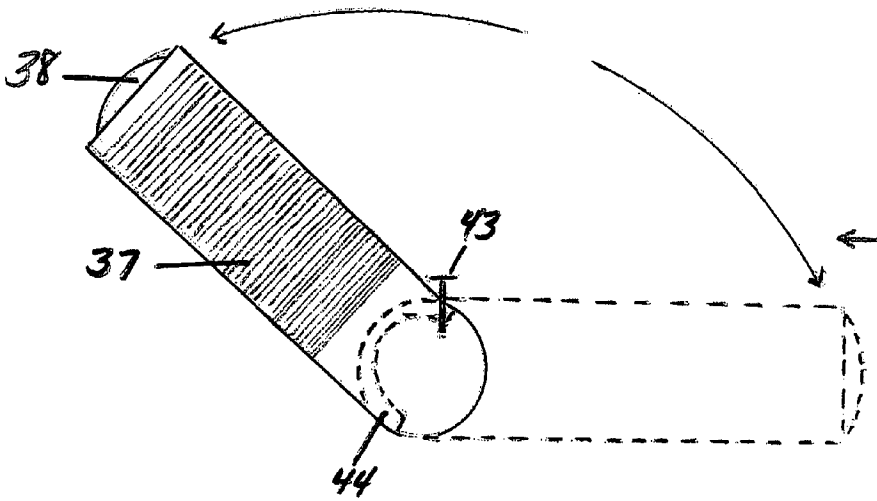

FIG. 9 A The front perspective of the swivel handle of the dual action recumbent cycle.

FIG. 9 B The side perspective of the swivel handle of the dual action recumbent cycle.

Figure 10:
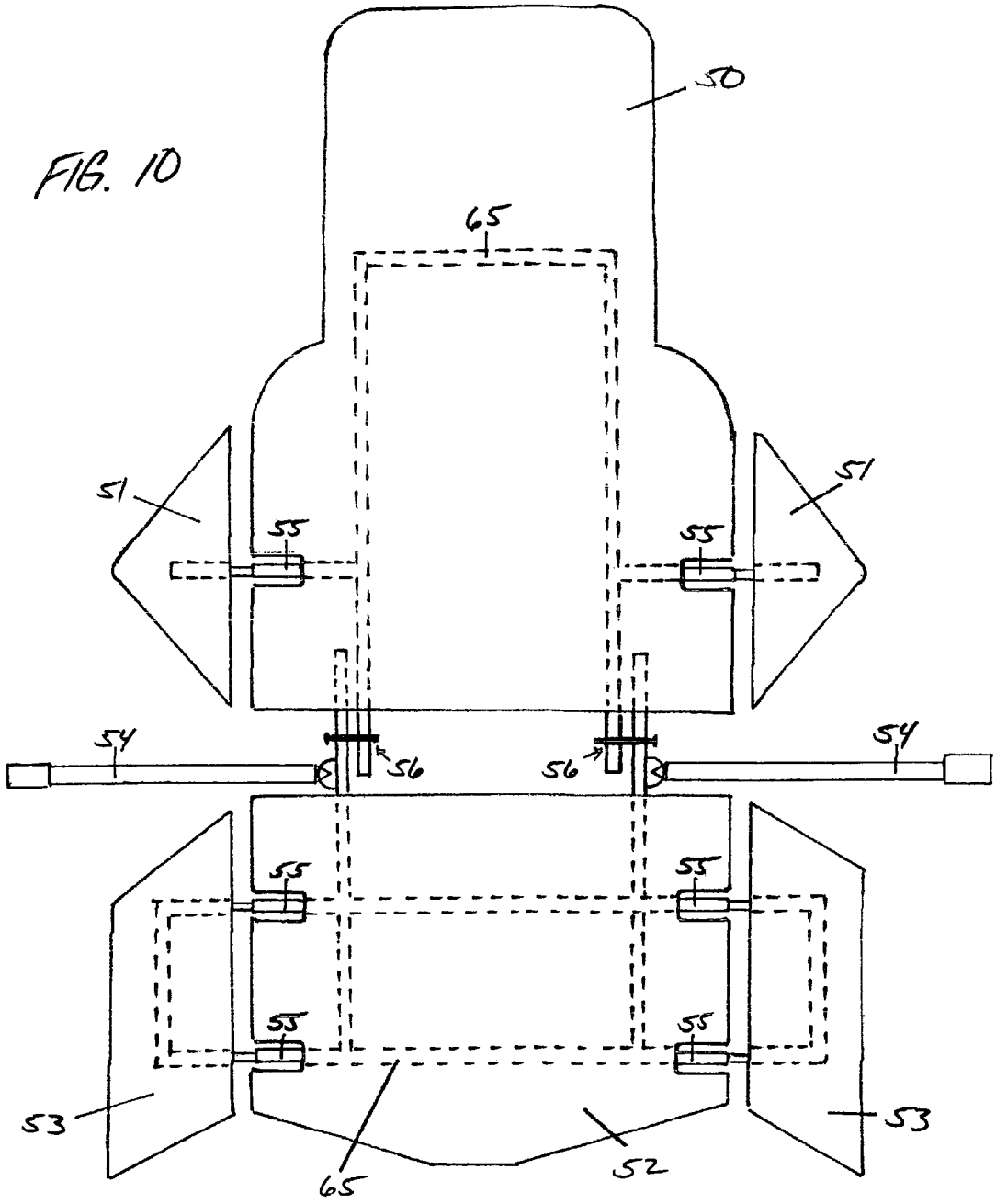

FIG. 10 A flattened laid out perspective of the dual action recumbent cycle's multi-configurable seat with adjustable leg and torso flaps.

Figure 11A:
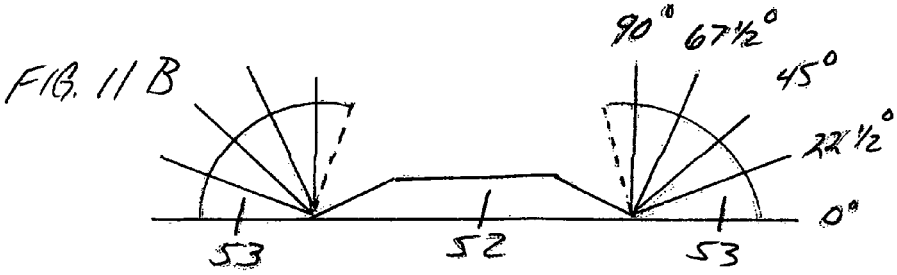
Figure 11A:
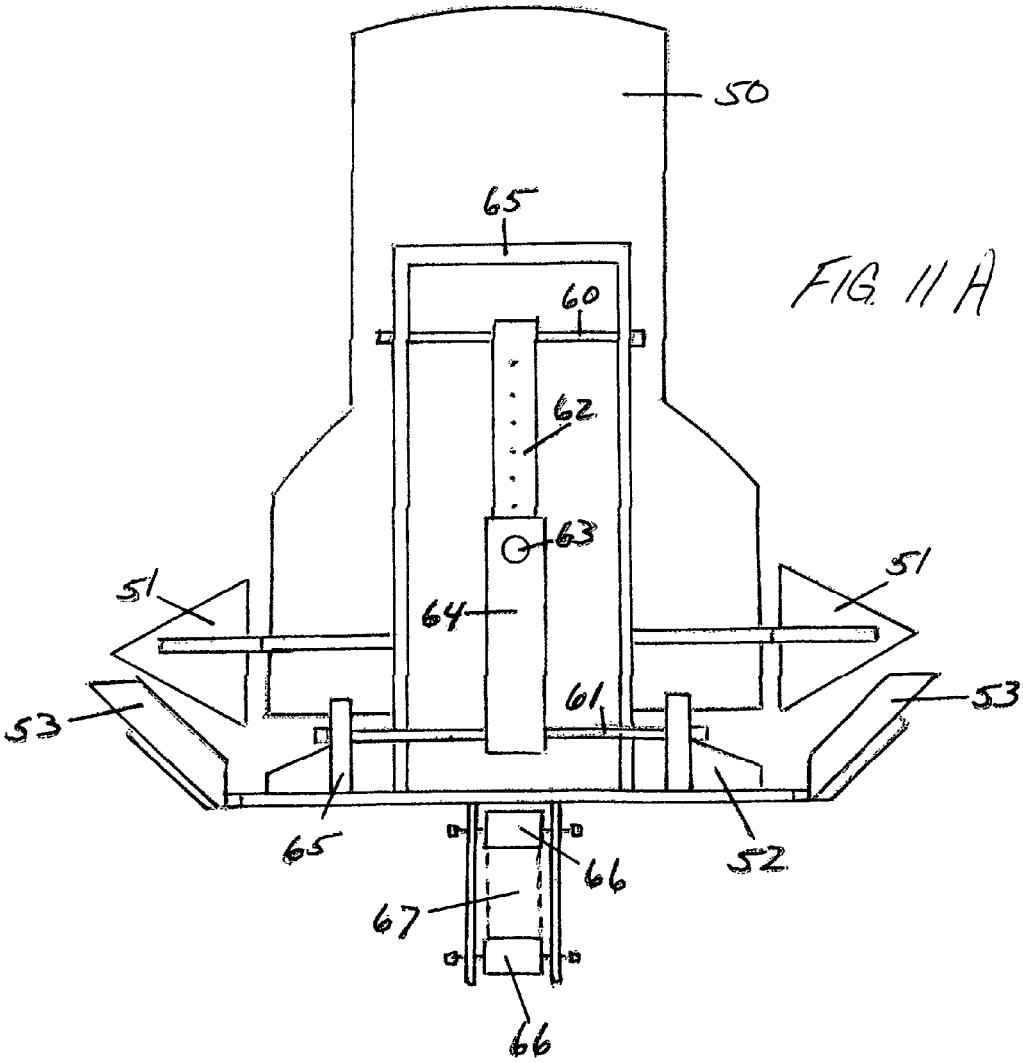

FIG. 11 A Rear perspective of the dual action recumbent cycle's multi-configurable seat with seat bottom leg flaps set at a 45 degree angle.

FIG. 11 B Diagram of the 5 locking positions of the seat bottom leg flaps.

Figure 12B:
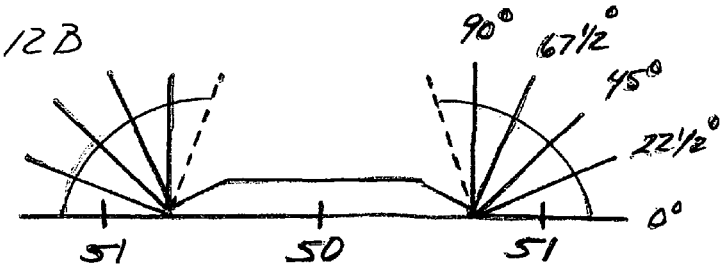
Figure 12A:
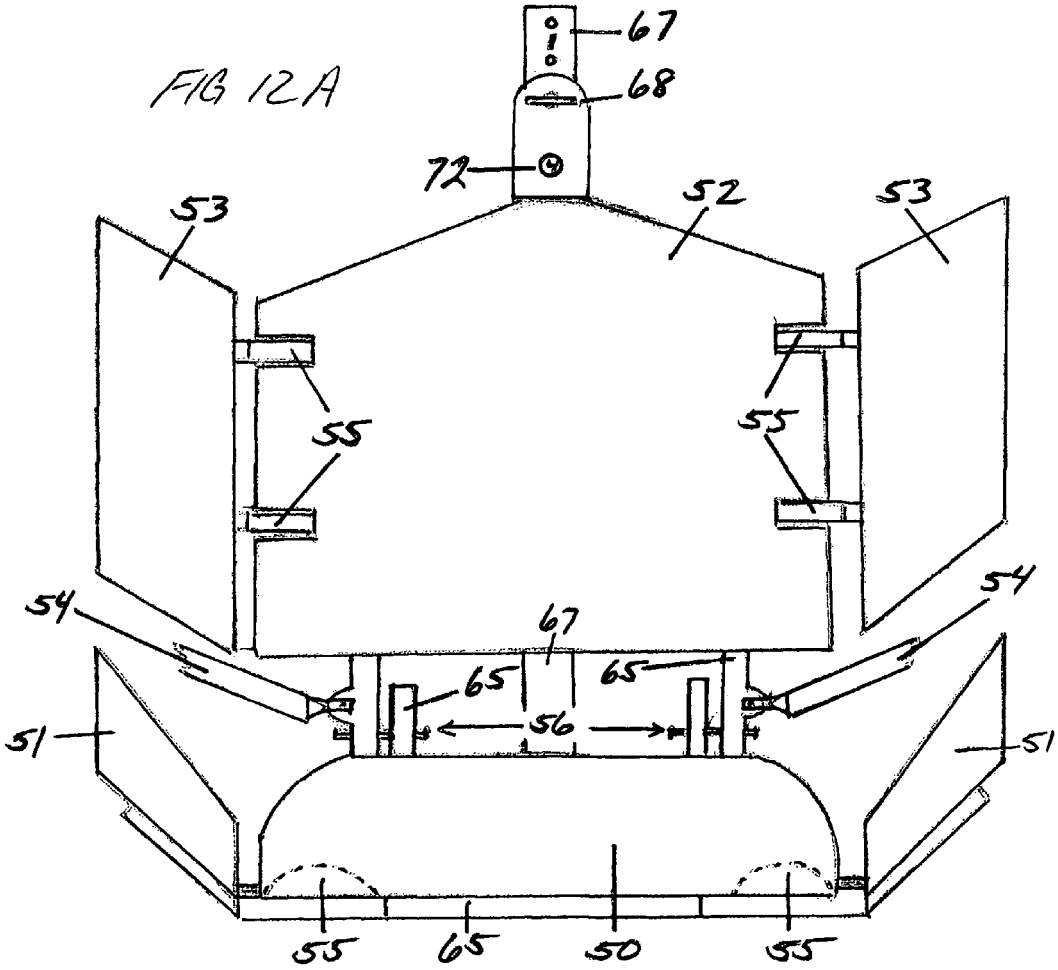

FIG. 12 A Top Perspective of the dual action recumbent cycle's multi-configurable seat with seat back core flaps set at a 45 degree angle.

FIG. 12 B Diagram of the 5 locking positions of the seat back core flaps.

DETAILED DESCRIPTION OF THE PREFERRED EMBODIMENT

Overall Description:

Referring now to the drawings, an apparatus embodying the principles of the present invention is illustrated in FIG. 1. The apparatus is a physical therapy or exercise machine which could be referred to as a dual action recumbent exercise cycle. Preferably the apparatus is made of steel in various stock forms such as plate stock, angle stock, solid round rod and tubular stock including round, square, and rectangular. In the following description the words telescopic or telescopes or a variation of such will be used in describing the function of some apparatus components. Telescopic for the purposes of this description simply means that the outside diameter of one piece of tubing is minimally smaller that the inside diameter of another piece of tubing thereby allowing the tubing with the smaller outside diameter to slide snugly in and out of the tubing with the larger inside diameter.

The basic function of the cycle is the same as the cycle described in U.S. Pat. No. 4,188,030. The apparatus incorporates all of the major muscle groups while providing effective cardiovascular conditioning. The apparatus is recumbent since the user is generally in a reclining position. The apparatus can be referred to as a cycle since it exercises the legs of the user through a circular/cyclical movement of the foot pedals 16. While pushing on the foot pedals 16 R/L, resistance exercises the legs and the lower body of the user. The arms and upper body of the user are exercised by the pushing and pulling against the resistance offered through the handlebar assemblies 24-38 R/L.

As shown in FIG. 1 the cycle is comprised of a wire mesh cage 20 encasing a vaned wheel 21, rotatably mounted on a frame 15 and arranged to absorb energy by movement of the broad surfaces of the vaned wheel 21 against the surrounding body of air. Rotation of the vaned wheel 21 is effected through a pair of foot pedals 16 R/L, connected to a chain and derailleur sprocket or hub mechanism 17, attached to a connecting arm 18 which is connected to the handlebar stems 24 R/L utilizing a yolk and pin connection 19. A connecting means 90 (best shown in FIG. 4) is provided through which each said foot pedal crank arm is fixedly secured to the outer end of a respective said drive crank arm to permit rotation of said drive shaft by foot operation. The handlebar stems 24 R/L are pivotally connected 23 to the frame 15 and are connected to a respective eccentric through a crank ring rotatably mounted on that eccentric and a drive bar connected to both the crank ring and the handlebar stem. The two eccentrics are arranged 180 degrees out of phase and are connected to the foot pedals 16 R/L so as to rotate in response to both the pivotal movement of the handlebar stems 24 R/L and the circular movement of the foot pedals 16 R/L. As the eccentrics are drivably connected to the vaned wheel 21, that vaned wheel 21 is caused to rotate in response to rotation of the eccentrics. A second drive means 91 is provided connecting the outer end of each drive crank arm to a respective one of said handlebar stems so that the drive shaft is caused to rotate in response to the oscillation of the handlebar stems. The second drive means is connected to the connecting means so as to be interposed between the outer end of each drive crank arm and the adjacent end of the respective foot pedal crank arm.

The Handlebar Assemblies 24-38 R/L:

The handlebar assemblies 24-38 R/L as shown in FIGS. 1, 2, 3, and 4 begin with a handlebar stem 24 pivotally connected 23 to the frame 15. The handlebar stems 24 R/L oscillate back and forth to and from the user at the pivotal axis 23 as force is placed on the foot pedals 16 R/L. The handlebar stems 24 R/L extend upward and rearward toward the user from the pivotal axis 23 to elbow bends 41 and 42 in the handlebar stems 24 R/L. Attached to the end of the handlebar stems 24 are the pivotal spring housing assemblies 25. Welded to the pivotal spring housing assemblies 25 are the extension arm housings 34 R/L. Telescoping in and out of the extension arm housings 34 R/L are the perforated handlebar extensions 35 R/L. FIG. 7 shows the underside of the perforated handlebar extension 35. There is a guide slot 39 machined into the perforated handlebar extension 35 and a guide slot alignment screw 40 which prevents the perforated handlebar extension 35 from rotating in the extension arm housing 34. Attached to the end of the perforated handlebar extensions 35 are the swivel handles 37 R/L. FIG. 9 A shows the range of positioning available with the swivel handles 37 R/L. For the largest percentage of users, the swivel handles 37 will be positioned upward and inward as shown in the front diagram of FIG. 9 A as well as FIGS. 2, 3, and 4. This positioning is representative of the most comfortable hand positioning a person would have as in holding the steering wheel of a car. However if the user prefers the swivel handles 37 R/L to be positioned perpendicular to the ground or horizontal to the ground, or any position in between, the option is available by a swivel handle guide slot 44 and a guide slot alignment screw 43 shown in both FIG. 9 A and FIG. 9 B. At the end of the swivel handle 37 is a derailleur shifting button 38 which changes the gear ratio in the chain and sprocket or hub mechanism 17 utilizing a cable (not shown) running through the swivel handle 37, the perforated handlebar extension 35, the extension arm housing 34, out the extension arm housing 34 through a hole at the bottom, along the outside of the handlebar stem 24, and the frame 15 to the chain and sprocket or hub mechanism 17.

FIG. 6 illustrates how the length of the perforated handlebar extension 35 from the pivotal spring housings 25 to the user is made with a plunger pin 36 located on the extension arm housing 34. The plunger pin 36 inserts inside one of the adjustment holes in the perforated handlebar extension 35. The pivotal spring housings 25 R/L as shown in FIGS. 1, 2, and 3, enable the extension arm housings 34 R/L, the perforated handlebar extensions 35 R/L and the swivel handles 37 R/L to initially rest vertically to the floor. A tightening knob 22 is used to immobilize the vaned wheel 21 prior to the user mounting the apparatus for safety reasons as well as securing all moving components when the apparatus is being moved to a different location. The perforated outline in FIG. 1 shows the overall handlebar pivot extension mechanism 25-38 adjusted and positioned horizontally to the user's chest level.

Upon beginning use of the apparatus the user pushes on the foot pedals 16 R/L which causes the handlebar assemblies 24-38 R/L to oscillate back and forth toward and away from the user. As one of the handlebar assemblies 24-38 comes toward the user, he or she simply reaches out, grabs the swivel handle 37 and pulls it down to his or her chest level. FIG. 8 shows the range of positioning available to the user. This wide range of positioning enables the handlebar assemblies 24-38 R/L to comfortably accommodate any user ranging in height from 4 foot 11 inches to 7 foot.

Inside the pivotal spring housing 25, is a torsion spring 28 as shown in FIGS. 5 and 6. Upon pulling down on the handlebar pivot extension mechanism 25-38, load is placed on the internally positioned torsion spring 28. This constant load/tension created by the torsion spring 28 exercises and conditions the user's tricep muscles located in the back of the upper arms. Since load is created when the user pulls down the handlebar pivotal extension mechanism 25-38, release of the swivel handle 37 causes the torsion spring 28 to uncoil thereby relieving the load, thereby retracting or moving the handlebar pivotal extension mechanism 25-38 away from the user with considerable velocity. A compression damper 33 which is attached to a retraction guard arm 32 using an eyelet end 46 on one end, and a ball and socket mechanism 47 on the extension arm housing 34 on the other end, controls the velocity and rate of return of the pivotal handlebar extension mechanism 25-38 away from the user. Both the compression damper 33 and the retraction guard arm 32 also prevent the pivotal handlebar extension mechanism 25-38 from over rotating and allows the handlebar pivotal extension mechanism 25-38 to return to its original resting position, which is vertical to the ground.

The Pivotal Spring Housing Assembly 25:

FIGS. 5, and 6, show the various components of the pivotal spring housing assembly 25. The components include a flanged connecting rod 26, a pivotal outside spring housing 27, a torsion spring 28 (right coiled and left coiled) with the torsion spring arms 29 positioned at 180 degrees from each other and perpendicular to the torsion spring 28 coils, a stationary inside spring housing 30, a retraction guard arm 32, a housing and connecting rod hole 31, and a compression damper 33.

Both the stationary inside spring housing 30, and the pivotal outside spring housing 27 are preferably machined out of solid steel rod. FIG. 6 shows the perforated lines within the housings, 27 and 30 outlining the steel which must be removed so the torsion spring 28 and the torsion spring arms 29 fit within the housing. The inside diameter of the spring housings 27 and 30 are minimally larger than the outside dimension of the torsion spring 28. The depth of steel removed from the inside of the housings 27 and 30 is such that the torsion spring 28 fits within the housings 27 and 30 when they are held together by the flanged connecting rod 26. Holes are also drilled within the housings 27 and 30 for positioning of the torsion spring arms 29 enabling load to be placed on the torsion spring 28. FIG. 6 illustrates that both the outside and inside spring housings 27 and 30 have a hole drilled through the center of them which is minimally larger than the outside dimensions of the flanged connecting rod 26. As shown in FIGS. 5 and 6 the stationary inside spring housing 30 is machined with a shaft which has an outside diameter minimally smaller than the inside diameter of the handlebar stem 24. The shaft portion of the stationary inside spring housing 30 also has a housing and connecting rod hole 31 drilled through it. A retraction guard arm hole 45 is also drilled into the top of the inside stationary spring housing for insertion of one end of the retraction guard arm 32.

FIGS. 5 and 6, illustrate that the housing and connecting rod hole 31 in the shaft portion of the stationary inside spring housing 30 is perpendicular to the hole for the torsion spring arm 29 on the inside of the stationary inside spring housing 30. As noted above, the hole for the retraction guard arm hole 45 is in the top of the stationary inside spring housing 30. The flanged head of the connecting rod 26 has a hole drilled through the center of it for insertion of one end of the retraction guard arm 32. This hole is also perpendicular to the connecting rod hole 31 drilled at the other end. The pivotal outside spring housing 27, like the stationary inside spring housing 30 has a hole drilled on the inside of the housing as shown in FIG. 6 for securing the torsion spring arms 29. The extension arm housing 34 is welded to the outside of the pivotal outside spring housing 27 in the approximately the same location of the torsion spring arm 29 hole on the inside.

Referring to FIGS. 6 and 8, assembly and installation of the pivotal spring housing assembly 25 as well as the application of load on the torsion spring 28 would be done as follows. One torsion spring arm 29 of the torsion spring 28 would be inserted into the hole on the inside of the stationary inside spring housing 30 at the 12 o'clock position. The other torsion spring arm 29 of the torsion spring 28 would be inserted in the corresponding hole inside the outside pivotal spring housing 27 at the 6 o'clock position with the extension arm housing 34 pointed downward. The flanged connecting rod 26 both aligns and holds together the housings 27 and 30 when it is inserted through the hole in the center of the pivotal outside spring housing 27, the torsion spring 28, and the hole in the center of the stationary inside spring housing 30. As shown in FIGS. 5 and 6, the flanged connecting rod 26 extends into the shaft portion of the stationary inside spring housing 30. The housing and connecting rod hole 31 in the flanged connecting rod 26 and the housing and connecting rod hole 31 in the shaft portion of the stationary inside spring housing 30 must align. This portion of the assembly is then inserted into the handlebar stem 24 which also has a housing and connecting rod hole 31 which must align with the housing and connecting rod holes 31 of the flanged connecting rod 26 and the shaft portion of the stationary inside spring housing 30. A bolt (not shown) is then inserted into the housing and connecting rod hole 31 and secured with a locking nut (not shown). Insertion of the bolt (not shown) into the housing and connecting rod hole 31 of the handlebar stem 24, the flanged connecting rod 26 and the shaft portion of the stationary inside spring housing 30 locks and immobilizes both the stationary inside spring housing 30 and the flanged connecting rod 26. The pivotal outside spring housing 26 rotates freely on the pivotal axis provide by the flanged connecting rod 26. To initiate load on the torsion spring 28, the extension arm housing 34 which is welded to the pivotal outside spring housing 27 is rotated up and away from the rearward portion of the exercise cycle approximately 270 degrees. The solid arrow on the pivotal outside spring housing 27 in FIG. 8 shows the direction of rotation in order to place load on the right coiled torsion spring 28 inside the housing components 27 and 30. The retraction guard arm 32 with the eyelet end 46 of the compression damper 33 attached is then inserted both through the hole in the center of the head of the flanged connecting rod 26 and the hole 45 on the top of the stationary inside spring housing. An external retaining ring 48 is placed on the retraction guard arm 32 at the point of exit from the hole in the head of the flanged connecting rod 26 in order to secure it in position. The other end of the compression damper 33 is secured to the extension arm housing 34 with a ball and socket attachment 47. The pivotal spring housing assembly 25 is now fully operational.

The Multi-Configurable Seat and Rear of the Exercise Cycle:

As shown in FIG. 1, the exercise cycle's seat components consisting of a seat back 50, seat back core flaps 51, a seat bottom 52, seat bottom leg flaps 53 are mounted on a seat frame 65 which can be adjustably positioned axially utilizing neoprene roller wheels 66 above and below a perforated/numbered spine 67. Locking the position of the seat is accomplished through a T-handled plunger pin 68 which inserts into equally spaced holes in the perforated/numbered spine 67 as shown in FIG. 12 A. The numerical adjustment setting for the seat can be viewed by the user through a view hole 72 also shown in FIG. 12 A.

As shown in FIGS. 11 B, and 12 B, the seat back core flaps 51, and the seat bottom leg flaps 53 can be adjusted to 5 different locking positions ranging from flat, 0 degrees to 90 degrees perpendicular to either the seat back 50 or the seat bottom 52. This is accomplished by using locking ratchet hinge mechanisms 55 which are devices well known in the art. These hinge mechanisms are commonly used in vinyl strapped folding beach chairs, also referred to as folding "banana" beach chairs which can be purchased at retail stores such as Walmart and Target.

FIG. 10 shows the location of the locking ratchet hinge mechanisms 55 within the seat frame 65 on both the seat back 50 and the seat bottom 52. When the seat bottom leg flaps 53 are in the flattened position, parallel to the ground, the seating area for the user's posterior is well in excess of the typical seat which is 24 inches wide. When the seat bottom leg flaps 53 are at 90 degrees or perpendicular to the ground, the seating area for the user's posterior is reduced to under 12 inches wide. When the user initially sits in the seat, he or she simply pulls up on the seat bottom leg flaps 53 to a comfortable position thereby "cupping" the seat to the user's posterior dimensions. The same application applies to the seat back core flaps 51. FIGS. 11 A and 12 A show the positioning of the respective flaps 51 and 53 adjusted to a 45 degree angle on the respective seat back and bottom 50 and 52. When the user exits the seat, the flaps 51 and 53 are simply pushed inward toward the seat back 50 and the seat bottom 52 which releases the locking mechanism within the hinge 55 allowing it to return to the flattened position.

An adjustable seat belt 54 is also incorporated on the seat. FIGS. 1, 10 and 12 show the placement location of the seat belt 54. This serves two purposes, first it compresses the lumbar vertebrae of the user back into the seat back 50 for support of the lower back and second, users with equilibrium issues due to afflictions such as stroke and Parkinson's disease are provided with additional safety and security from falling off the apparatus.

The angle or tilt of the seat back 50 can also be adjusted to the users preference utilizing a telescopic mechanism on the rear of the seat back 50. FIG. 1, shows a right side perspective of the seat back elevation tube 62 which telescopes in and out of the seat back support tube 64. FIG. 11 A illustrates that the seat back elevation tube 62 is connected pivotally to an upper support bar 60 which is connected to the seat frame 65. The same can be said with regard to the seat back support tube 64 which is connected pivotally to a lower support bar 61 which is also connected to the seat frame 65. FIG. 10 shows the two parts of the seat frame 65, one for the seat back 50 and one for the seat bottom 52 are pivotally connected at points 56. Referring back to FIG. 11 A, as the seat back 50 is moved forward or backwards at the pivot point 56, the seat back elevation tube 62 telescopes in and out of the seat back support tube 64. Once the seat back's 50 desired level of recline is achieved, a plunger pin 63 inserts into a hole in the seat back elevation tube 62 thereby locking in and securing the position.

The tilt of the entire seat can also be changed to the users desires. As shown in FIG. 1 a front seat elevation rod 70 extends up into the perforated numbered spine 67. A hole is drilled through the perforated numbered spine 67 and the front seat elevation rod 70. A bolt 80 is inserted through the two components and attached with a locking nut (not shown) The bolt acts as a pivotal axis for the front seat elevation rod 70. The front seat elevation rod 70 has elevation adjustment holes drilled at specific increments and inserts into the front seat elevation support tube 71. A threaded elevation rod bolt 69 is removed and the forward portion of the perforated/numbered spine 67 is either lifted up or pushed down to the desired tilt level. Once the desired level is achieved, the threaded elevation rod bolt 69 is reinserted and screwed in to secure the position. When the front tilt of the seat is being adjusted upward or downward, the rear base 81 (see FIGS. 3 and 4) moves slightly forward or backward toward or away from the foot pedals 16 R/L of the cycle. A pair of roller wheels 78 R/L attached to the ends of the rear base 81 enable the adjustment to be done easily.

The tilt of the rear of the seat is accomplished in a similar fashion. Again referring to FIGS. 1 and 3, a rear frame elevation tube 77 telescopes in and out of a rear frame elevation support tube 75 enabling the rear tilt of the seat to be adjusted utilizing a plunger pin 76 which inserts into adjustment holes drilled into the rear frame elevation tube 77. The roller wheels 78 R/L attached to the rear base again enable the adjustment to be done easily. Changing the tilt of either the forward or rear angle of the seat changes the intensity of the exertion placed on the legs of the user. This is useful especially in the rehabilitation of knee injuries or knee replacement patients.

Accommodating the rehabilitation or exercise needs of a wheelchair bound user or patient is also feasible. First begin by removing the threaded elevation rod bolt 69 and pulling up on the perforated/numbered spine 67 until the front seat elevation rod 70 comes out of the front seat elevation support tube 71. Once this is done, the front seat elevation rod 70 can be used as a handle similar to the handle of a dolly. By grasping the front seat elevation rod 70 (handle) an individual can tilt the entire rear assembly 50-81 of the exercise cycle up onto the rear frame transport wheels 79 R/L and move the entire rear portion of the apparatus completely away and apart from the front part of the apparatus. By tethering the wheelchair to the front seat elevation support tube 71 the user or patient has both the foot pedals 16 R/L and the handlebar assemblies 24-38 R/L available for exercise or rehabilitation purposes.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

| DUAL ACTION RECUMBENT EXERCISE CYCLE COMPONENTS | |
|---|---|
| 15. | Frame |
| 16. | Foot Pedal |
| 17. | Chain and Sprocket/Hub Mechanism |
| 18. | Connecting Arm |
| 19. | Yolk and Pin Connection |
| 20. | Wire Mesh Cage |
| 21. | Vaned Wheel |
| 22. | Tightening Knob |
| 23. | Pivotal Axis of Handlebar Stems |
| 24. | Handlebar Stems |
| 25. | Pivotal Spring Housing Assembly |
| 26. | Flanged Connecting Rod |
| 27. | Pivotal Outside Spring Housing |
| 28. | Torsion Spring |
| 29. | Torsion Spring Arms |
| 30. | Stationary Inside Spring Housing |
| 31. | Housing and Connecting Rod Hole |
| 32. | Retraction Guard Arm |
| 33. | Compression Damper |
| 34. | Extension Arm Housing |
| 35. | Perforated Handlebar Extension |
| 36. | Plunger Pin |
| 37. | Swivel Handle |
| 38. | Derailleur Shifting Button |
| 39. | Guide Slot |
| 40. | Guide Slot Alignment Screw |
| 41. | Elbow Bend #1 |
| 42. | Elbow Bend #2 |
| 43. | Swivel Handle Set Screw |
| 44. | Swivel Handle Guide Slot |
| 45. | Retraction Guard Arm Hole |
| 46. | Eyelet Attachment |
| 47. | Ball and Socket Attachment |
| 48. | External Retaining Ring |
| 50. | Seat Back |
| 51. | Seat Back Core Flaps |
| 52. | Seat Bottom |
| 53. | Seat Bottom Leg Flaps |
| 54. | Adjustable Seat Belt |
| 55. | Locking Ratchet Hinge Mechanism |
| 56. | Pivotal Axis for the Seat Back and Bottom |
| 60. | Upper Support Bar |
| 61. | Lower Support Bar |
| 62. | Seat Back Elevation Tube |

-continued

| DUAL ACTION RECUMBENT EXERCISE CYCLE COMPONENTS | |
|---|---|
| 63. | Plunger Pin |
| 64. | Seat Back Support Tube |
| 65. | Seat Frame |
| 66. | Neoprene Roller Wheels |
| 67. | Perforated/Numbered Spine |
| 68. | T-Handled Plunger Pin |
| 69. | Threaded Elevation Rod Bolt |
| 70. | Front Seat Elevation Rod |
| 71. | Front Seat Elevation Support Tube |
| 72. | View Hole |
| 75. | Rear Frame Elevation Support Tube |
| 76. | Plunger Pin |
| 77. | Rear Frame Elevation Tube |
| 78. | Roller Wheels |
| 79. | Seat and Rear Frame Transport Wheels |
| 80. | Bolt |
| 81. | Rear Base |

What is claimed is:

1. A dual action recumbent exercise cycle, comprising:

a frame including a rearward placed beam or spine;

a movable seat which is horizontally displaced on said beam or spine from a foot pedal and handlebar stems on said frame;

an energy absorbing means rotatably mounted on said frame;

a substantially horizontal drive shaft having two ends rotatably carried by said frame;

first drive means connecting said drive shaft to said energy absorbing means to cause rotation thereof in response to rotation of said drive shaft;

a drive crank arm secured to each of two opposite end portions of said drive shaft and extending laterally there from in opposite directions;

two foot pedals;

connecting means through which each said foot pedal crank arm is fixedly secured to the drive shaft to permit rotation of said drive shaft by foot operation;

two handlebar stem assemblies comprising a pair of spring loaded, telescopic, dampened handlebar extension assemblies mounted on said frame for oscillatory movement, each said spring loaded, telescopic, dampened handlebar extension assembly comprising: a handlebar stem, a pivotal spring housing assembly, an extension arm housing, a perforated handlebar extension, a swivel handle, a retraction guard arm, and a compression dampening mechanism secured to both said retraction arm guard and said extension arm housing; and second drive means connecting an outer end of each said drive crank arm to a respective one of said handlebar stems so that said drive shaft is caused to rotate in response to said oscillation of the handlebar stems, said second drive means being connected to said connecting means so as to be interposed between the outer end of each said drive crank arm and an adjacent end of a respective foot pedal.

2. A dual action recumbent exercise cycle of claim 1 further comprising:

a) variable and/or exponential effort mechanism; and b) a multi-configurable seat.

3. A dual action recumbent exercise cycle as claimed in claim 1 wherein a derailleur mechanism is mounted on said frame as a means of controlling resistance or load from said energy absorbing means mounted on said frame.

4. A dual action recumbent exercise cycle as claimed in claim 1 wherein said pivotal spring housing assemblies are respectively secured to the upper portion of the handlebar stems.

5. A dual action recumbent exercise cycle as claimed in claim 1 wherein said pivotal spring housing assembly includes a stationary inside spring housing, a flanged connecting rod which provides a stable pivot for a pivotal outside spring housing, a torsion spring for increasing load on the telescopic dampened handlebar extension assemblies, the retraction guard arm, and the compression dampening mechanism.

6. A dual action recumbent exercise cycle as claimed in claim 5 wherein said flanged connecting rod provides a stable pivot for the outside spring housing thereby providing a variety of angles of the telescopic dampened handlebar extension assembly to the user.

7. A dual action recumbent exercise cycle as claimed in claim 5 wherein said stationary inside spring housing and said flanged connecting rod provide a secure housing for said retraction guard arm thereby providing a secure base for attachment of said compression dampening mechanism.

8. A dual action recumbent exercise cycle as claimed in claim 1 wherein said compression dampening mechanism retards velocity of the spring loaded telescopic dampened handlebar extension assembly away from the user toward a forward area of the exercise cycle when said telescopic dampened handlebar extension assembly is released by the user.

9. A dual action recumbent exercise cycle as claimed in claim 2 wherein said multi-configurable seat comprising a seat back, a pair of seat back torso flaps, a seat bottom, a pair of seat bottom leg flaps is mounted on a pivotal seat frame, incorporating adjustable locking hinge mechanisms between said seat back and seat back torso flaps and said adjustable locking hinge mechanisms between said seat bottom and said seat bottom leg flaps, thereby providing variable positions of support to the user's torso and posterior areas regardless of said user's torso and posterior dimensions.

10. A dual action recumbent exercise cycle, comprising:

a frame including a rearward placed beam or spine;

a movable, multi-configurable seat which is horizontally displaced on said beam or spine from a foot pedal and handlebar stems on said frame, comprising: a seat back, a pair of seat back torso flaps, a seat bottom, a pair of seat bottom leg flaps is mounted on a pivotal seat frame, incorporating adjustable locking hinge mechanisms between said seat back and seat back torso flaps and said adjustable locking hinge mechanisms between said seat bottom and said seat bottom leg flaps, thereby providing variable positions of support to the user's torso and posterior areas regardless of said user's torso and posterior dimensions;

an energy absorbing means rotatably mounted on said frame;

a substantially horizontal drive shaft having two ends rotatably carried by said frame;

first drive means connecting said drive shaft to said energy absorbing means to cause rotation thereof in response to rotation of said drive shaft;

a drive crank arm secured to each of two opposite end portions of said drive shaft and extending laterally there from in opposite directions;

two foot pedal pedals;

connecting means through which each said foot pedal crank arm is fixedly secured to the drive shaft to permit rotation of said drive shaft by foot operation;

two handlebar stems mounted on said frame for oscillatory movement;

second drive means connecting the outer end of each said drive crank arm to a respective one of said handlebar stems so that said drive shaft is caused to rotate in response to said oscillation of the handlebar stems, said second drive means being connected to said connecting means so as to be interposed between the outer end of each said drive crank arm and an adjacent end of a respective foot pedal;

a variable and/or exponential effort mechanism by which a user varies the a load resistance; and a pair of spring loaded, telescopic, dampened handlebar extension assemblies, each assembly having a swivel handle and a compression dampening mechanism.

11. A dual action recumbent exercise cycle as claimed in claim 10 wherein a derailleur mechanism is mounted on said frame as a means of controlling resistance or load from said energy absorbing means mounted on said frame.

12. A dual action recumbent exercise cycle as claimed in claim 10 wherein each said spring loaded, telescopic, dampened handlebar extension assembly includes said handlebar stem, a pivotal spring housing assembly, an extension arm housing, a perforated handlebar extension, a swivel handle, a retraction guard arm, and a compression dampening mechanism secured to both said retraction arm guard and said extension arm housing.

13. A dual action recumbent exercise cycle as claimed in claim 12 wherein said handlebar stem has a pivotal spring housing assembly secured to the upper portion thereof.

14. A dual action recumbent exercise cycle as claimed in claim 12 wherein said pivotal spring housing assembly includes a stationary inside spring housing, a flanged connecting rod which provides a stable pivot for a pivotal outside spring housing, a torsion spring for increasing load on the telescopic dampened handlebar extension assemblies, the retraction guard arm, and the compression dampening mechanism.

15. A dual action recumbent exercise cycle as claimed in claim 14 wherein said flanged connecting rod provides a stable pivot for the outside spring housing thereby providing a variety of angles for the telescopic dampened handlebar extension assembly to the user.

16. A dual action recumbent exercise cycle as claimed in claim 14 wherein said stationary inside spring housing and said flanged connecting rod provide a secure housing for said retraction guard arm thereby providing a secure base for attachment of said compression dampening mechanism.

17. A dual action recumbent exercise cycle as claimed in claim 12 wherein said compression dampening mechanism retards velocity of the spring loaded telescopic dampened handlebar extension assembly away from the user toward the forward area of the exercise cycle when said telescopic dampened handlebar extension assembly is released by the user.

18. A dual action recumbent exercise cycle, comprising:

a frame including a rearward placed beam or spine;

a movable, multi-configurable seat assembly which is horizontally displaced on said beam or spine from a foot pedal and handlebar stems on said frame, the movable, multi-configurable seat assembly adapted to be removed from the exercise cycle to accommodate a wheelchair bound user, wherein the frame comprises: a release rod coupled to an elevation support tube, wherein the rod is removable to uncouple the seat assembly, and wherein the elevation support tube is adapted for coupling to the wheelchair;

an energy absorbing means rotatably mounted on said frame;

a substantially horizontal drive shaft having two ends rotatably carried by said frame;

first drive means connecting said drive shaft to said energy absorbing means to cause rotation thereof in response to rotation of said drive shaft;

a drive crank arm secured to each of two opposite end portions of said drive shaft and extending laterally there from in opposite directions;

two foot pedal crank arms;

connecting means through which each said foot pedal crank arm is fixedly secured to the drive crank arm drive shaft to permit rotation of said drive shaft by foot operation;

two handlebar stems mounted on said frame for oscillatory movement;

second drive means connecting the outer end of each said drive crank arm to a respective one of said handlebar stems so that said drive shaft is caused to rotate in response to said oscillation of the handlebar stems, said second drive means being connected to said connecting means so as to be interposed between the outer end of each said drive crank arm and the adjacent end of the respective foot pedal crank arm;

a variable and/or exponential effort mechanism by which a user varies the a load resistance; and a pair of spring loaded, telescopic, dampened handlebar extension assemblies, each assembly having a swivel handle and a compression dampening mechanism.

* * * * *